United States Patent [19]

Cook

[11] 4,201,011

[45] May 6, 1980

[54] TOY MOTORCYCLE

[75] Inventor: John S. Cook, Redondo Beach, Calif.

[73] Assignee: Mattel, Inc., Hawthorne, Calif.

[21] Appl. No.: 922,149

[22] Filed: Jul. 5, 1978

[51] Int. Cl.[2] ..... A63H 29/20

[52] U.S. Cl. ..... 46/209

[58] Field of Search ..... 46/209, 206, 202, 201

[56] References Cited

U.S. PATENT DOCUMENTS

| | | | |
|---|---|---|---|
| 3,886,682 | 6/1975 | Ieda et al. | 46/202 |
| 639,567 | 12/1899 | Henderson | 46/202 |
| 1,599,117 | 9/1926 | Conlon | 46/202 |
| 2,588,681 | 3/1952 | Wixson | 46/202 |
| 2,829,467 | 4/1958 | Pagano | 46/209 |
| 3,621,607 | 11/1971 | Morrison et al. | 46/202 |
| 3,757,459 | 9/1973 | Buck et al. | 46/202 |

*Primary Examiner*—Houston S. Bell, Jr.

*Attorney, Agent, or Firm*—John G. Mesaros; Max E. Shirk; Ronald M. Goldman

[57] ABSTRACT

A toy motorcycle having a flywheel rotatably coupled to the frame, the flywheel being configured for fitting within opposite shell halves of a wheel having an annular gear member centrally disposed about the periphery thereof and recessed from the tire periphery. The flywheel has a pinion extending beyond the shell half, and a gear train operatively interconnects the pinion of the flywheel with the annular gear member through a clutch mechanism. Motive power is provided to the flywheel by means of a pull string wound about a spring biased drum coupled to the gear train through a unidirectional clutch assembly.

15 Claims, 5 Drawing Figures

TOY MOTORCYCLE

BACKGROUND OF THE INVENTION

The background of the invention will be discussed in two parts:

1. Field of the Invention

This invention relates to toy vehicles and more particularly to a two wheeled flywheel powered toy motorcycle.

2. Description of the Prior Art

Inertia wheels or flywheels as a source of storing energy is well known. For example, U.S. Pat. No. 639,567 discloses a bicycle having a rear wheel with a flywheel mounted for rotation between the spokes thereof, the flywheel being rotatable through gearing in a direction opposite to the direction of rotation of the wheel for acting as a stabilizer. U.S. Pat. No. 1,599,117 likewise discloses a flywheel arrangement in which a weighted flywheel is secured to the hub of the bicycle wheel for storing energy.

Flywheels and inertia wheels have likewise been utilized in toy vehicles such as those vehicles shown in U.S. Pat. Nos. 2,829,467; 3,621,607; and 3,886,682. In the first of the above-referenced patents, the flywheel is mounted within a space formed in the front wheel, the flywheel being secured to the axle with rotation thereof imparting movement to the wheel upon placing the vehicle on a flat surface to cause friction between the wheel hub and the front axle to cause the wheel to move to propel the motorcycle. The slip fit between the hub of the wheel and the flywheel axle permits the flywheel to rotate at a speed faster than that of the wheel to act as a gyro for stabilizing the motorcycle.

U.S. Pat. No. 3,621,607 has an O-ring encircling the flywheel for providing traction for propelling the vehicle. The last of the three above-mentioned patents includes a launching apparatus which is manually operated for driving a flywheel within a toy motorcycle and releasing the motorcycle in response to a change in speed of manual rotation of the launching mechanism.

It is an object of the present invention to provide a new and improved flywheel powered toy vehicle.

It is another object of the invention to provide a flywheel powered toy motorcycle.

It is a further object of the present invention to provide a flywheel powered toy motorcycle having pull string means for energizing the flywheel and a shift clutch for connecting the flywheel to the drive wheel through a gear train.

SUMMARY OF THE INVENTION

The foregoing and other objects of the invention are accomplished by providing a toy vehicle such as a motorcycle having one wheel thereof generally hollow and formed from shell halves, the wheel having an annular gear member about the periphery thereof interposed between tire halves and recessed from the surface of the tire halves. A flywheel is rotatably mounted within the hollow opening inside the wheel, the flywheel having a pinion portion operatively coupled through a gear train to the annular gear member. A shift clutch is interposed within the gear train to disengage the annular gear of the drive wheel during acceleration of the flywheel which is accomplished by a pull string encircling a spring biased drum operatively coupled to a unidirectional clutch assembly for accelerating the flywheel.

Other objects, features and advantages of the invention will become apparent from a reading of the specification when taken in conjunction with the drawings in which like referenced numerals refer to like elements in the several views.

DESCRIPTION OF THE PREFERRED EMBODIMENT

Figure 1:
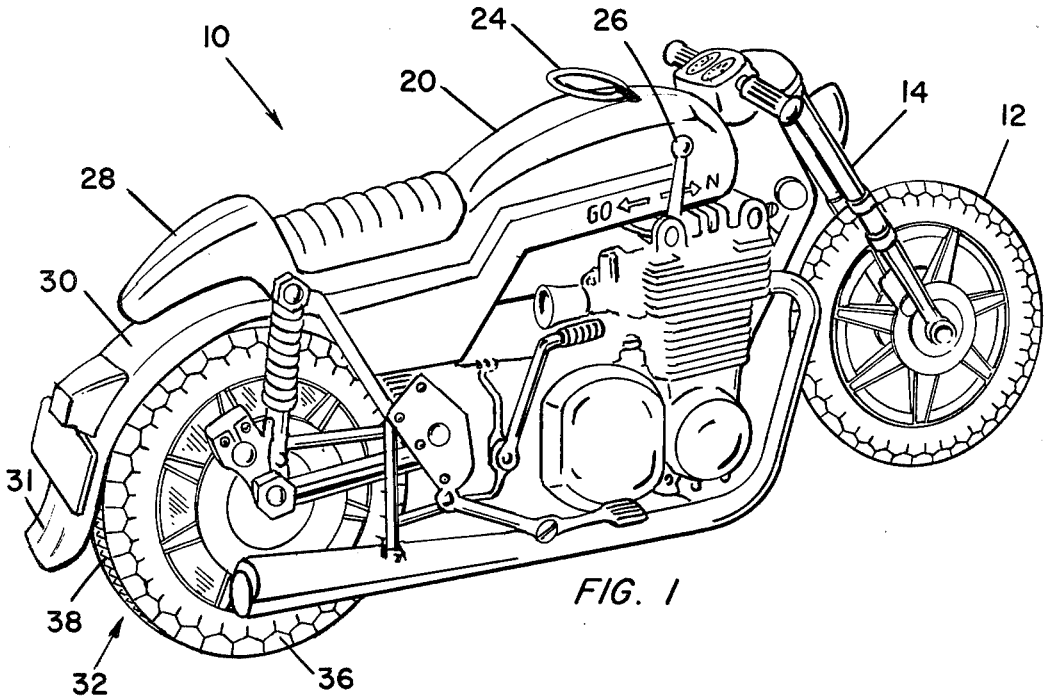
FIG. 1 is a perspective view of the flywheel powered toy vehicle according to the invention.
Figure 5:
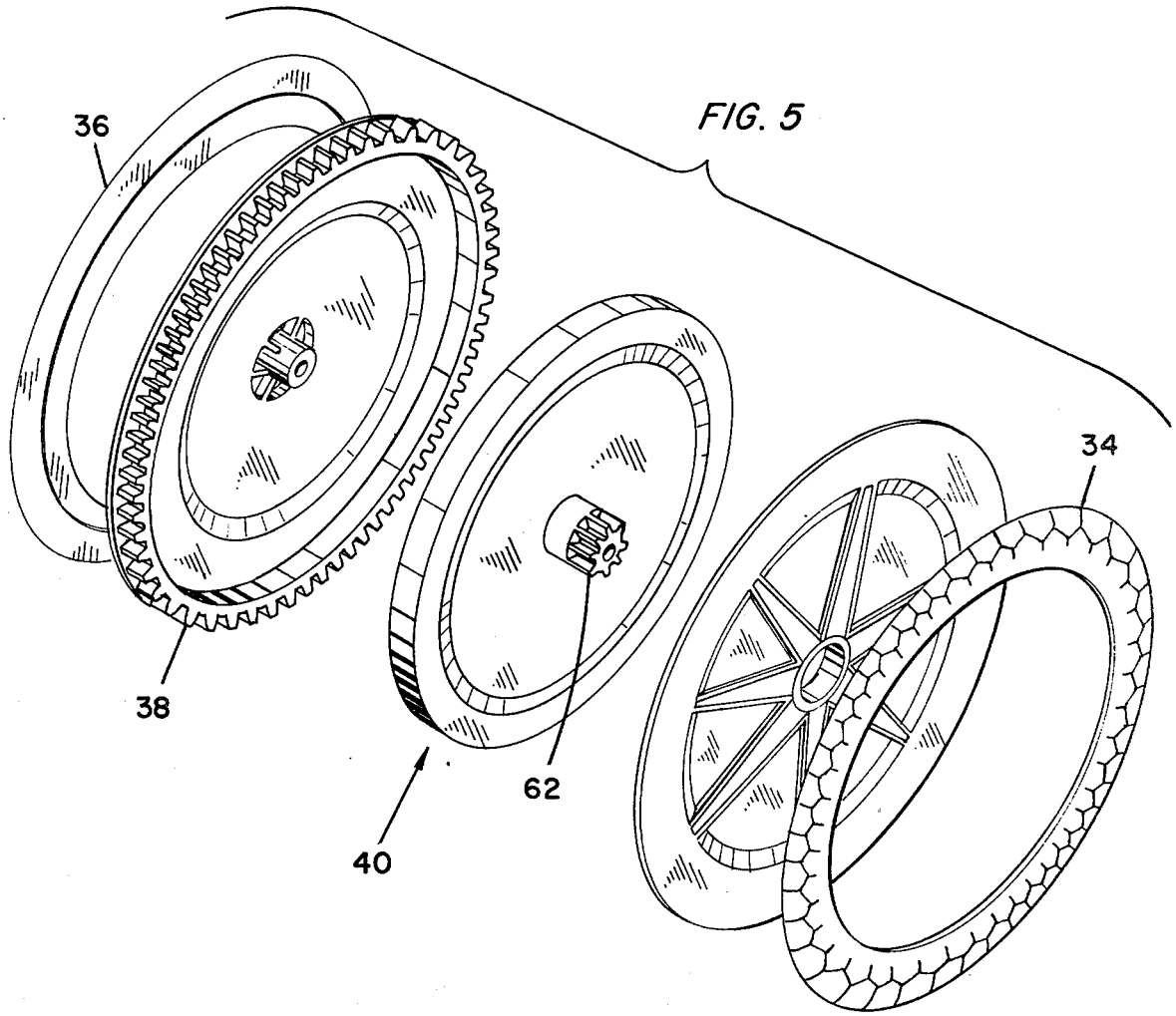
FIG. 5 is an exploded perspective view illustrating the rear wheel and flywheel assembly.
Figures 2, 3:
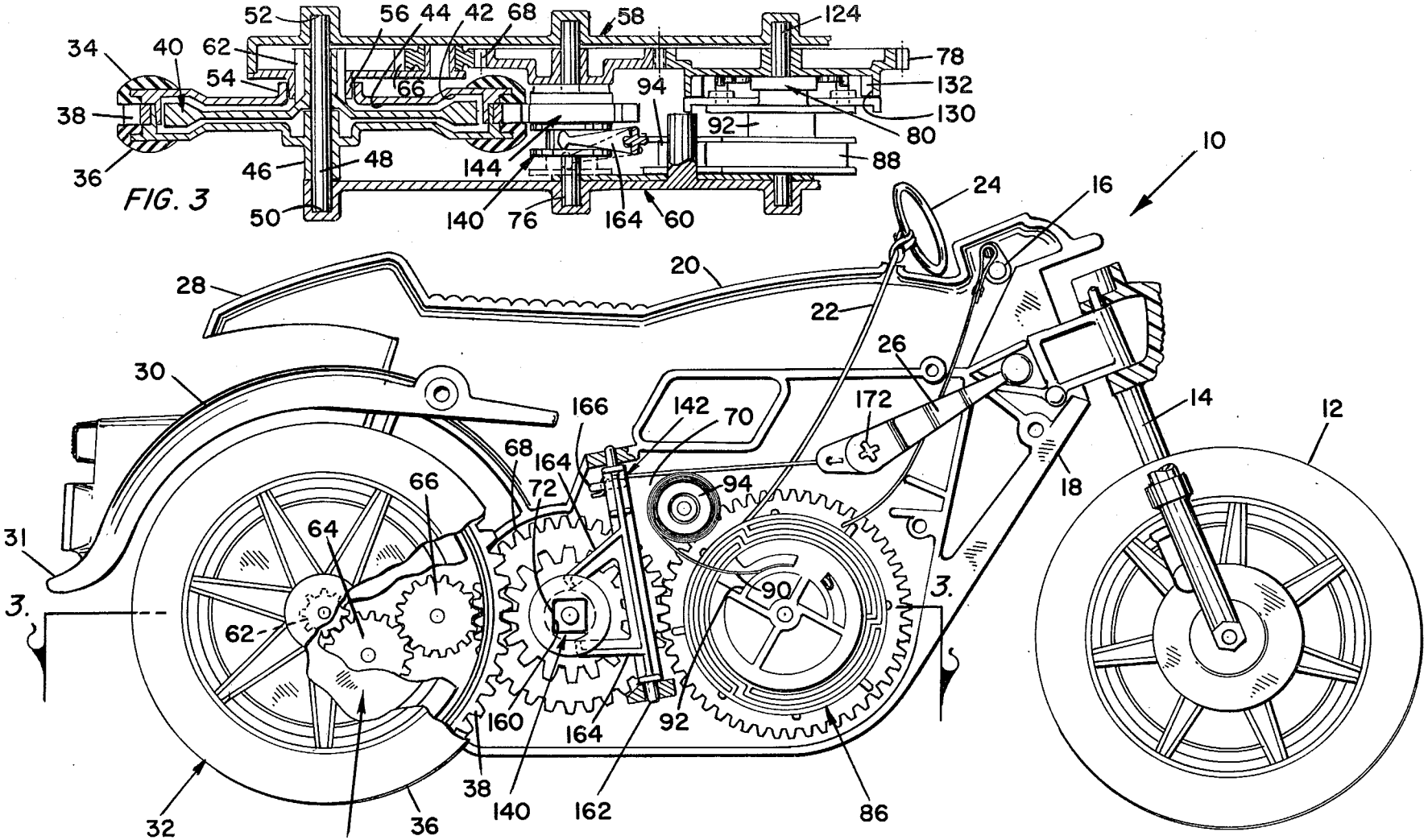
FIG. 2 is a side elevational view, partially in cross section and partially broken away of the vehicle of FIG. 1.
FIG. 3 is a cross sectional view taken generally along line 3—3 of FIG. 2.

Referring now to the drawings and particularly to FIG. 1 there is shown a toy vehicle such as a motorcycle generally designated 10 configured to simulate the appearance of a full-sized motorcycle, the motorcycle having a front wheel 12 rotatably mounted between a pair of forks 14 steerably controlled by handlebars 16, the front assembly being pivotally coupled to the front portion 18 of the vehicle 10. A simulated gas tank 20 has a pull string 22 extending through an eyelet thereof with a pull ring 24 secured to the end of the pull string. As will hereinafter be described, the pull string 22 functions to provide inertia to the flywheel for providing the motive power for the vehicle 10. Extending out from the front 18 of the vehicle 10 beneath the gas tank 20 is a simulated gear shift lever 26 which is pivotable between a first and second position. The rear end 28 of the motorcycle 10 is provided with a fender 30 which, as will hereinafter be described, is rigidly mounted to the rear end 28 of the motorcycle 10. Rotatably mounted to the framework of vehicle 10 beneath the fender 30 is a rear wheel assembly generally designated 32 having a split tire including a left tire half 34, and a right tire half 36 with an annular gear member 38 interposed between the two tire halves with the teeth of annular gear member 38 recessed from the outer periphery of the tire halves 34 and 36. Briefly, the operation of the motorcycle 10 will be described. The motorcycle 10 is held in one hand with the pull ring 24 held in the other hand, and with gear shift lever 26 in one position repeated pulling of the ring 24 will accelerate the flywheel 40 (see FIG. 3) which will rotate independently of the rear wheel. Then with the vehicle 10 placed on a surface, the gear shift lever 26 pivoted to the second position to thereby shift the flywheel 40 into engagement with the gear train which is coupled to the annular gear member 38 to thereby drive the vehicle 10. The rear fender 30 is a suitably weighted mass and serves a two-fold purpose, the first being to provide weight above the rear wheel assembly 32, and the second purpose being to act as a pivot limiting means if the motorcycle accelerates sufficiently rapidly to perform a "wheelie", that is where the torque is sufficient to lift the front wheel 12 from the ground upon acceleration of the motorcycle 10. Referring now to FIGS. 2–5, as best illustrated in FIGS. 3 and 5, the rear wheel assembly 32 includes the two wheel halves 34 and 36 which are generally shell halves which, when joined together, provides a hollow opening therein having an enlarged opening 42 adjacent the tire portion thereof with a narrow opening 44 in the spoke portion. As illustrated in FIG. 3, the wheel half 36 has a centrally disposed bearing portion 46 rotatably engaging an axle 48 secured within cup-shaped bearing recesses 50 and 52 disposed on opposite sides of the motorcycle 10. The wheel half 34 is provided with a larger diameter bearing portion 54 which rotatably encircles a bearing aperture 56 formed within the mounting framework half 58, the framework halves 58 and 60 being used to assemble the components therebetween as a power module.

Also rotatably mounted on axle 48 for rotation independent of wheel assembly 32 is the flywheel 40 which is provided with a pinion portion 62 extending through the bearing aperture 56. The flywheel 40 is configured to have a thin cross sectional dimension fitting within the opening 44 with an enlarged peripheral mass for fitting within the annular opening 42 formed within the interior of the rear wheel assembly 32, thus providing the bulk of the mass adjacent the perimeter of the flywheel 40.

Figure 4:
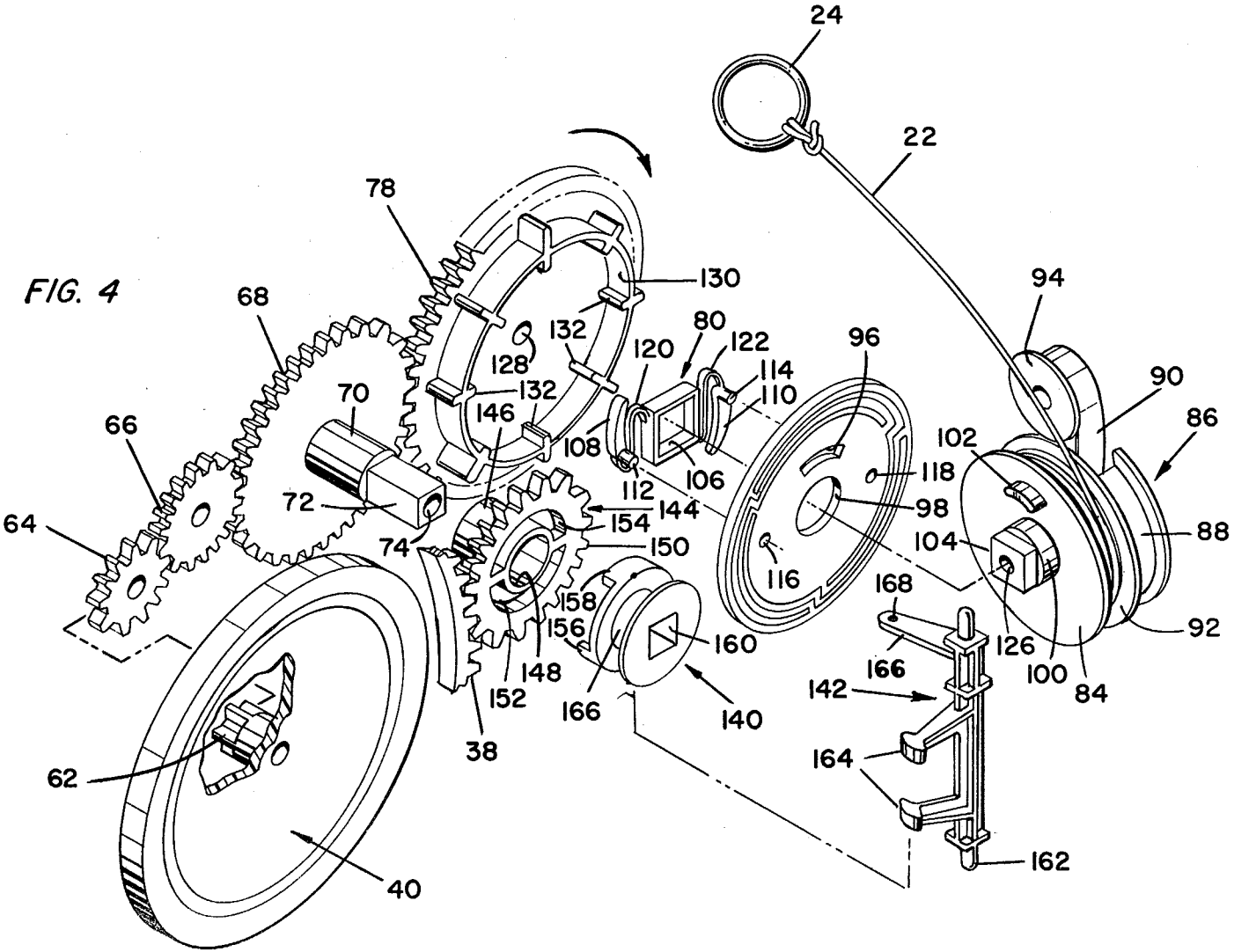
FIG. 4 is an exploded perspective view of the drive train of the vehicle of FIG. 1.

The operative drive train or gear train components are best illustrated in FIG. 4. The wheel halves 34 and 36 have been eliminated from this view and the annular gear member 38 is only partially illustrated adjacent flywheel 40. The pinion 62 meshes with a first gear member 64 of slightly larger diameter, gear member 64 then being coupled through an idler gear member 66 to a drive gear 68, the drive gear 68 having a shaft portion including a circular shaft portion 70 and a square shaft portion 72, the two shaft portions and drive gear 68 having an axially extending aperture 74 therein for receiving an axle 76 (see FIG. 3) therethrough. The drive gear 68 meshes with a power gear 78 which is driven through a unidirectional clutch assembly including a pawl member generally designated 80, a clutch disc generally designated 82 and a drive disc generally designated 84, the drive disc 76 being formed in one face of a double spool assembly generally designated 86.

The double spool assembly includes a first reel portion 88 having the pull string 22 wound thereabout for drawing against the force of a coil spring 90 having one end thereof secured within the second reel portion 92 with the other end thereof encircling another spool member 94 with the end fastened thereto, the coil spring 90 as viewed in FIG. 2 being arranged for uncoiling as the fully wound pull string 22 is withdrawn, the pull string 22 then being rewound around its reel portion 88 due to the restoring force of coil spring 90.

Referring to FIG. 3 as well as FIG. 4, the clutch disc 82 is provided with an arcuate slot 96 radially offset from a central aperture 98 having a diameter slightly larger than the diameter of a circular shaft portion 100 on drive disc 84 for engagement thereover, the slot 96 engaging an arcuate tab 102 on the face of drive disc 84, the length of tab 102 being slightly smaller than the length of slot 96 to permit a limited amount of angular displacement of the clutch disc 82 relative to the drive disc 84 when so mounted. Extending outwardly from circular shaft portion 100 of drive disc 84 is a square shaft portion 104 having a diagonal measurement slightly smaller than the diameter of aperture 98 for extending therethrough and having a length sufficient for receiving a matingly configured opening 106 formed in the main body portion of pawl member 80. The pawl member has first and second tangentially extending pawls 108 and 110, each having an axially extending pivot pin 112 and 114 respectively for engaging apertures 116 and 118 respectively formed in the clutch disc 82. The apertures 116 and 118 are diametrically opposed and with the pawl member 80 mounted on drive disc 84 with the pivot pins 112 and 114 within apertures 116 and 118 respectively, relative movement between the drive disc 84 and clutch disc 82 pivots the free ends of the pawls 108 and 110 outwardly or inwardly depending on the direction of relative rotation. The strips 120 and 122 interconnecting pawls 108 and 110 respectively to the main body portion of pawl member 80 are generally resilient with the entire pawl member 80 being molded of a one piece generally rigid yet deformable type plastic material. An axle 124 (see FIG. 3) passing through the aperture 126 of the double spool assembly 86 and thence through the central aperture 128 of power gear 78 aligns the parts in the assembled position with the pawl member 80 fitting within a circular recess 130 formed on one surface of power gear 78, the recess 130 having a plurality of radially inwardly extending rib segments 132, the rib segments 132 being arranged in diametrically opposed pairs, any pair of which may be selectively contacted by the free ends of pawls 108 and 110. The arcuate outer surfaces of pawls 108 and 110 when in the non-pivoted or retracted position define a circle of slightly smaller diameter than the distance between the edges of a pair of diametrically opposed rib segments 132. As the relative displacement between clutch disc 82 and drive disc 84 occurs, the pawl ends are displaced outwardly for engaging a pair of rib segments 132 to thereby drive the same with the rotation of power gear 78 being in the facing direction of the free ends of pawls 108 and 110, this direction of rotation being indicated by the arrow adjacent power gear 78. The particular power gear unidirectional clutch assembly is more fully shown and described in U.S. patent application Ser. No. 761,496 entitled "Clutch Mechanism" by Toshio Yamasaki filed Jan. 21, 1977, such application being assigned to the assignee of the instant invention, and now U.S. Pat. No. 4,135,328.

The repeated pulling of pull string 22 thus imposes a unidirectional rotation on power gear 78 which thereby rotates flywheel 40 through drive gear 68, idler gear 66 and the first gear member 64. Referring particularly to FIGS. 2–4, this power is selectively transmitted to the annular gear member 38 by means of a shift clutch assembly which includes a shift clutch member generally designated 140, a shift fork generally designated 142 and a shift gear member generally designated 144. The shift gear member 144 has a journal portion 146 having a circular aperture 148 extending therethrough for rotatably engaging the circular shaft portion 70 of drive gear 68. The gear portion 150 of shift gear member 144 is in constant meshing engagement with the annular gear member 38, and with the shift lever 26 in a first position, the shift gear member 144 is stationary notwithstanding rotation of drive gear 68. The surface of shift gear member 144 opposite drive gear 68 is provided with a pair of arcuate recesses 152 and 154 configured for selective mating engagement with arcuate tabs 156 and 158 extending axially from one surface of shift clutch member 140. The shift clutch member 140 is provided with a square aperture 160 for slidable mating engagement with the square shaft portion 72 of drive gear 68, the shift clutch member 140 being axially displaceable on the square shaft portion 72 to selectively enable the arcuate tabs 156 and 158 to engage arcuate recesses 152 and 154. This axial displacement is accomplished by means of shift fork 142 which is pivotable about a pivot shaft 162 with a pair of parallel arms 164 extending generally perpendicular thereto for fitting within a drum portion 166 of the shift clutch member 140. The upper end of shift fork 142 is provided with an offset arm 166 having an aperture 168 in the end thereof for receiving one end of a wire control rod 170 (see FIG. 2) the other end of which is coupled to the lower end of the gear shift lever 26 which is pivotally mounted adjacent the lower end thereof about a pivot shaft 172.

As shown in FIG. 2, the shaft 162 of shift fork 142 is pivotally mounted within the housing about a generally upright axis with the arms 164 thereof positioned within the drum portion of shift clutch member 140 and with the gear shift lever 26 in the forward position as illustrated in FIG. 2, the shift clutch member 140 will be in the dotted line position illustrated in FIG. 3, that is out of engagement with the shift gear member 144. In this position, the flywheel 40 may be accelerated as previously described with the rear wheel stationary. The flywheel 40 will be rotating in the clockwise direction as viewed in FIG. 2. The child then places the motorcycle on an appropriate surface such as a floor or the like and moves the gear shift lever 26 rearwardly thus pivoting shift fork 142 until the arm 164 thereof is in the solid line position depicted in FIG. 3 with the shift clutch member 140 axially displaced on square shaft portion 74 until the tabs 156 and 158 fit within the recesses 152 and 154 of the shift gear member 144 thus imparting rotation to this gear member which is then transmitted to the annular gear member 38 and thus to the rear wheel assembly 32. At this point the heavy weighted rear fender 30 of the motorcycle 10 assists in providing traction for propelling the motorcycle 10. If the inertia of the flywheel 40 is sufficiently great, as soon as the clutch shift member 140 engages the shift gear member 144, the front end 18 of the motorcycle 10 will rise to thus perform a "wheelie" with this rotation of the motorcycle 10 about the rear wheel being resisted and limited by the flared tip 31 of the rear fender 30 of the motorcycle 10. With the rear wheels split into shell halves 34 and 36 and the annular gear member 38 recessed beneath the outer periphery of the tire so formed, the vehicle 10 may be constructed in a compact arrangement with a suitable gear reduction between the speed of the flywheel 40 and that of the rear wheel assembly 32 thus providing stabilization during propulsion of the motorcycle 10.

While there has been shown and described a preferred embodiment, it is to be understood that various other adaptations and modifications may be made within the spirit and scope of the invention.

What is claimed is:

1. In a toy vehicle, the combination comprising:

a supporting structure;

a drive wheel assembly having a generally hollow wheel having an annular gear member affixed to the periphery thereof and tire portions on opposite sides of said annular gear member, the periphery of said annular gear member being recessed relative to said tire portions;

a flywheel mounted for rotation relative to said supporting structure, said flywheel being within said hollow wheel, and said wheel is mounted for rotation relative to the same axis as said flywheel;

drive means;

means interconnecting said drive means and said flywheel for rotating the same; and means operatively coupled to said annular gear member and said interconnecting means for selectively rotating said annular gear member in response to rotation of said flywheel.

2. The combination according to claim 1 wherein said flywheel has a pinion portion and said interconnecting means includes a gear train.

3. The combination according to claim 2 wherein said drive means includes manually operable means coupled to said gear train for rotating said flywheel.

4. The combination according to claim 1 wherein said means operatively coupled to said annular gear member includes clutch means.

5. The combination according to claim 4 wherein said clutch means includes a shift gear member in meshing engagement with said annular gear member and a shift clutch member for selectively driving said shift member in response to rotation of said flywheel.

6. The combination according to claim 5 wherein said interconnecting means includes a gear train having a drive gear rotatably mounted within said structure, said drive gear having a shaft with a circular shaft portion and a square shaft portion, said shift gear member having a circular aperture engaging said circular shaft portion and said shift clutch member having a square aperture for engaging said square shaft portion and being axially displaceable thereon.

7. The combination according to claim 6 wherein said shift gear member is provided with at least a pair of recesses in a surface thereof and said shift clutch member is provided with tab portions on a face thereof, said tab portions being configured for engaging said recesses with said shift clutch member axially displaced toward said shift gear member.

8. The combination according to claim 7 wherein said vehicle further includes a manually operable shift fork engaging said shift clutch member for axial displacement thereof.

9. The combination according to claim 8 wherein said drive means includes a power gear and manually operable means interconnected by a unidirectional clutch assembly for rotating said power gear in one direction of rotation.

10. The combination according to claim 9 wherein said manually operable means includes a pull string, a reel member and a coil spring, said pull string having one end thereof secured to said reel member and said coil spring is connected to said reel member for biasing said reel member against a force of retracting the pull string from said reel member.

11. The combination according to claim 10 wherein said toy vehicle is a toy motorcycle and said drive wheel assembly is the rear wheel assembly thereof.

12. In a toy motorcycle, the combination comprising:

a framework;

a front wheel rotatably mounted on said framework;

a rear drive wheel assembly coupled to said framework;

manually operable motor means mounted at least partially within said framework;

gear means interconnecting said manually operable motor means and the drive wheel of said drive wheel assembly for rotating the drive wheel in response to operation of said motor means; and a weighted fender member mounted on said framework above and rearwardly of said drive wheel, said fender member having a weight sufficient to enable said toy motorcycle to commence travel with said front wheel elevated when said motor means are operative with the drive wheel engaging a supporting surface.

13. The combination according to claim 12 wherein said drive wheel assembly includes a generally hollow drive wheel and a fly wheel mounted for rotation relative to said framework within said drive wheel.

14. The combination according to claim 13 wherein said drive wheel has an angular gear member affixed to the periphery thereof and tire portions on opposite sides of said angular gear member, the periphery of said angular gear member being recessed relative to said tire portions.

15. The combination according to claim 14 wherein said gear means includes a gear member coupled to said angular gear member.

* * * * *